United States Patent [19]

Kapler

[11] Patent Number: 4,592,605

[45] Date of Patent: Jun. 3, 1986

[54] APPARATUS FOR PREVENTING THE TWISTING OF AN ELECTRICAL CORD OR CABLE

[76] Inventor: Albert W. Kapler, 6 Travers Ave., Edison, N.J. 08817

[21] Appl. No.: 700,617

[22] Filed: Feb. 11, 1985

[51] Int. Cl.[4] ..... H01R 39/12

[52] U.S. Cl. ..... 339/8 R; 339/8 P; 339/8 PB

[58] Field of Search ..... 339/5 R, 5 M, 8 R, 8 P, 339/8 PB

[56] References Cited

U.S. PATENT DOCUMENTS

| | | | |
|---|---|---|---|
| 1,649,276 | 11/1927 | Adam | 339/8 PB |
| 2,502,252 | 3/1950 | Faile | 339/8 PB |
| 2,523,081 | 9/1950 | Wendt | 339/5 M |
| 4,533,796 | 8/1985 | Engelmore | 339/8 R X |

FOREIGN PATENT DOCUMENTS

| | | | |
|---|---|---|---|
| 562438 | 5/1957 | Italy | 339/8 PB |

*Primary Examiner*—Eugene F. Desmond
*Attorney, Agent, or Firm*—Arthur L. Plevy

[57] ABSTRACT

Apparatus for preventing the undesirable twisting of an input wire or cable includes a housing having an input and output port and having an internal hollow. Located within the hollow is a ball bearing assembly having an inner and outer race electrically connected to the other by means of the roller bearings. The outer race is rigidly secured to the housing while the inner race has a central aperture into which aperture is positioned a partial circular conductive plate. An input wire is electrically connected to the outer race while an output wire is electrically connected to the plate associated with the inner race. Thus the bearing assembly provides a connection between the wire connected to the outer race and the wire connected to the inner race. The conductive plate is associated with an elongated rod which rod is coupled to adjacent bearing assemblies via their associated plates. Each bearing assembly is associated with an individual input and output wire where the output wires as coupled to the conductive plates all rotate the same amount due to the rod to compensate for and to prevent undue twisting of an output line cord of that associated with a telephone subset or other device.

21 Claims, 7 Drawing Figures

APPARATUS FOR PREVENTING THE TWISTING OF AN ELECTRICAL CORD OR CABLE

BACKGROUND OF THE INVENTION

This invention relates to apparatus for preventing the twisting of an electrical cord or cable and more particularly to an apparatus which contains a bearing assembly for preventing the twisting or coiling of a telephone wire.

The prior art is replete with a number of patents which relate to the problem of avoiding the twisting or coiling of various wires. An example of such art is depicted in U.S. Pat. No. 3,437,976 entitled SWIVEL CONNECTOR FOR ELECTRIC CORD issued on Apr. 8, 1969 to R. A. Nelson. This patent shows a receptacle for placing into a plug which has a housing which contains a swivel connector.

In the housing there is a bearing assembly 24 which can rotate with respect to an input and output plug for preventing twisting an electrical cord. Other patents such as U.S. Pat. No. 3,271,273 entitled CONDUCTIVE BALL BEARING by R. G. Willing issued on Sept. 6, 1966. This patent shows a conductive ball bearing where the device is used in many applications including those requiring rotating cables. It prevents cables from twisting while rotating.

Other patents such as U.S. Pat. No. 4,106,831 entitled REVOLVING CABLE-TO-HOUSING CONNECTION by W. Albrecht shows a revolving feed which contains a socket member which prevents the twisting of a wire or cable by allowing the cable to rotate as for use in a power tool or other similar devices. Essentially, in view of the prior art there appears to be no devices directed to telephone lines or cables as for example those used for both residential and business purposes.

As is well known, a telephone cord or cable will twist over prolonged use and the twisting and coiling creates many hazardous situations apart from the fact that it is inconvenient to the user and must be constantly unraveled.

In reviewing the prior art devices, one will see that such devices are relatively expensive and complicated to make and use and are not directed to a cable such as a telephone cable which incorporates a plurality of separate individual wires. It is, therefore, an object of the present invention to provide an improved apparatus particularly adapted for preventing the twisting or coiling of a telephone cable which apparatus is simple to fabricate, easy to install and reliable in operation.

BRIEF DESCRIPTION OF THE PREFERRED EMBODIMENT

Apparatus for preventing the undesirable twisting of an input wire or cable of a given length and of the type capable of twisting or coiling during use comprising a housing having an input port and an output port and having an internal hollow, with said input wire directed into said hollow via said input port, a conductive ball bearing assembly having an outer and an inner race and operative to rotate with respect to one another, with a central aperture associated with said inner race, with said outer race rigidly secured to said housing and having electrically coupled thereto said input wire, a plate located and positioned within said central aperture and fabricated from a conductive material, said plate having electrically coupled thereto an output wire directed through said output port, said plate being of a partial circular configuration to therefore occupy a portion of said central aperture, and a rod coupled to said plate and having said output wire directed about said rod, whereby if said output wire twists said inner race, plate and rod will rotate to maintain said outer wire in a non-twisted state.

DETAILED DESCRIPTION OF THE FIGURES

Figure 1:
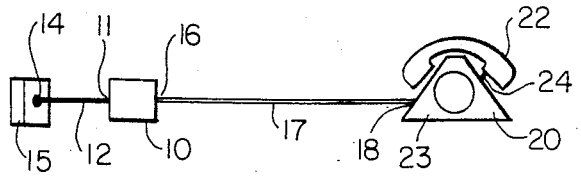
FIG. 1 is a diagrammatic view depicting a use of the apparatus according to this invention.

Referring to FIG. 1, there is shown the device 10 which apparatus or device has an input port 11 which is connected to an input cable 12. The end of cable 12 terminates in a male telephone jack 14 which jack can be inserted into a telephone wall receptacle 15.

Figure 7:
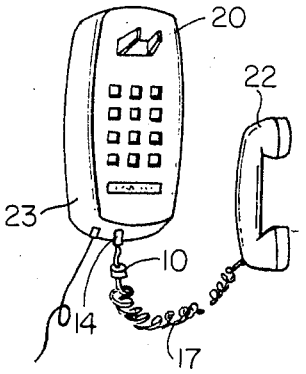
FIG. 7 is a perspective view of a telephone employing the apparatus of the present invention.

The housing 10 has an output port 16 which terminates in a cable 17 for connection to a telephone subset 20 via a conventional telephone jack 18. Essentially, the apparatus 10 will prevent twisting of the line 17 during use of the telephone. It is also noted that the apparatus 10 may be employed directly at the subset 20 to couple the handset 22 to the base 23 via the typical telephone cord 24 as shown in the embodiment of FIG. 7. Hence the location of the unit 10 can be employed at many different locations associated with the telephone instrument.

Figure 2:
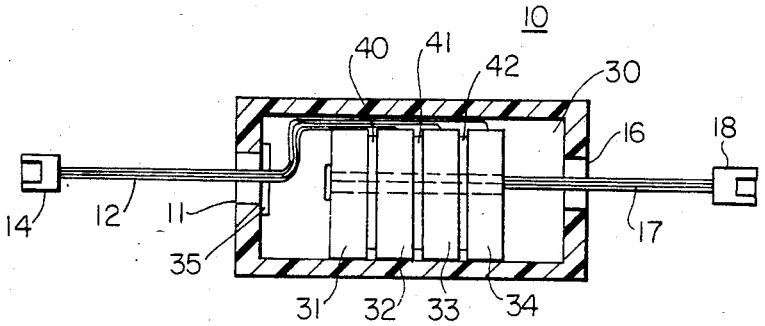
FIG. 2 is a partial sectional view of the apparatus.

Referring to FIG. 2, there is shown a cross sectional view of the housing 10. Essentially, the housing 10 as indicated has an input port 11 and output port 16. The cable 12 which in the case of a telephone line is a four-wire cable is directed through the input port 11 and terminates in a telephone jack 14 The housing has an internal hollow 30 with the output cable 17 directed through the output port 16 and terminates in a telephone jack 18. It is, of course, understood that the length of cables 12 and 17 can be of any length desired.

Located within the housing are four ball bearing assemblies designated as 31, 32, 33 and 34. As will be explained, each ball bearing assembly as 31 is associated and connected to an input wire from cable 12 and has an output wire connected thereto to form cable 17. Hence the four ball bearing assemblies shown accommodate the four telephone wires, as will be explained.

Each of the bearing assemblies as 31 have an outer race which is rigidly secured to the housing 10. The inner race which of course is rotatable with respect to the outer race is free to rotate. The input cable 12 has a stop member such as a grommet 35 associated therewith to prevent pulling the cable from the housing. The cable 12, as indicated, contains four wires which are secured together in a jacket but the jacket, is removed inside the hollow of the housing 10 to expose the four wires which as will be explained are directed to separate one of each of the ball bearing sections 31 to 34.

The assemblies 31 to 34 are separated by means of annular insulating members as 40, 41 and 42 which provide electrical isolation between the bearing assemblies.

Figure 3:
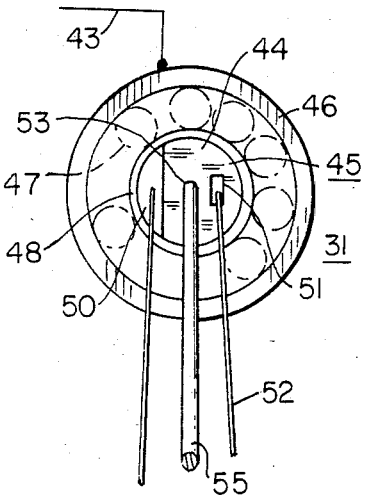
FIG. 3 is a front plane view of a bearing assembly employed in this invention.

Referring to FIG. 3, there is shown a front view of a typical bearing assembly as assembly 31 of FIG. 2. As indicated, a ball bearing has an outer race 46 which is rotatably coupled by a series of roller bearings 47 to the inner race 48. An input wire from cable 12 such as wire 43 is electrically connected to the outer race 46 which is rigidly secured to the housing 10.

Figure 4:
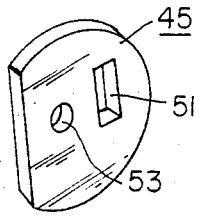
FIG. 4 is a perspective plan view of a conductive plate used in this invention.

The inner race 48 is associated with a central aperture 44 which central aperture has secured therein a conductive plate 45 which is shown in greater detail in FIG. 4. Plate 45 is a partial circular configuration and—namely, may be between $\frac{2}{3}$ to $\frac{3}{4}$ of a circle. Thus there is a space 50 which is provided when conductive plate 45 is secured within the central aperture 44 of the inner race 48. The plate 45 has an elongated aperture 51 which aperture accommodates the bare end of a wire 52 which is placed through the aperture 51 and electrically connected to the conductive plate 45 by means of a solder or welded joint. The plate 45 contains another circular aperture as 53 which aperture accommocates an elongated rod 55.

As will be explained, the rod 55 which may be plastic is directed through co-axial apertures in each of the plates 45 associated with each bearing assembly as 31 to 34. The rod causes the inner races to rotate in the same amount and in the same direction to thereby prevent undue twisting or coiling of the wire during use.

Figure 5:
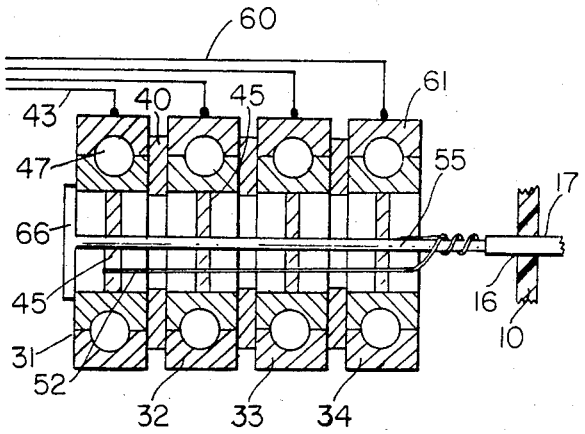
FIG. 5 is a cross sectional view of four bearing assemblies used in conjunction with a telephone cable.

Referring to FIG. 5, there is shown a cross sectional view to give one a clearer understanding of operation. The same reference numerals apply to depict the same parts. As seen in FIG. 4, each bearing assembly as 31 has an associated plate as 45. Rod 55 is directed through the coaxial aperture 53 of each of the central plates 45 and is firmly secured to each plate by means of a force fit through the aperture or otherwise. The rod 55 extends toward the output port 16 of the housing 10 where each output wire from each assembly as wire 52 is directed about the rod prior to formation of the output cable 17. In this manner each of the wires as wire 52 is rigidly secured about the rod 55.

The input wires as wire 43 and wire 60 are all electrically connected to the outer race of each associated bearing assembly as outer race 46 for 31 and outer race 61 for assembly 34. Bearings, as is well known, are conductive in that the roller balls as 47 electrically connect the outer race to the inner race. This is true of most commercial bearings in general and there are bearings available which are fabricated to provide excellent electrical connection between the inner and outer races. The rod 55 is terminated in a stop member 66 which essentially is a flange so that it cannot be pulled through the central apertures. Thus each bearing assembly electrically connects the input wire 43 to the associated output wire as wire 52. The output wires as 52 are associated with the conductive plate 45.

Output wire 52 of bearing assembly 31 is then directed through the space 50 formed between the central apertures 45 of the inner race and the edge of the associated plate as shown in FIG. 3. Thus the output wires as wire 52 are all directed through the spaces of the inner race to form the output cable 17. As one can ascertain, as the wire 17 twists the rod will cause all the plates as connected to the inner races to rotate in a direction to compensate for the twist, thus effectively maintaining the outer wire or cable 17 in a non-twisted state.

Figure 6:
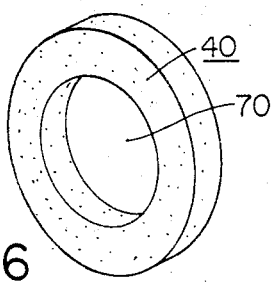
FIG. 6 is a perspective view of an insulating member employed between bearing assembly.

Referring to FIG. 6, there is shown a plan view of an insulator spacer member as members 40, 41 and 42 of FIG. 2. Essentially the member 40 is an elastomeric member and may be fabricated from rubber or a suitable plastic. The diameter of the inner aperture 70 of member 40 is much larger than the diameter of the central aperture 44 of the inner race with the outer diameter of member 40 being relatively equal to the diameter of the bearing. Hence the elastomeric member 40 is sandwiched between bearing assemblies 31 and 32 as shown in FIG. 2 and provides electrical insulation between the conductive bearing members.

The plate 45, as indicated, is a conductive plate and is soldered or welded to the inner periphery of the central aperture 44 associated with the inner race. As one can ascertain, ball and roller bearings are well known and they consist of two annular components known as races, as indicated above—namely, an inner and an outer race. The rolling elements or the balls are retained in a cage between the races. In regard to this invention, many different types of well known ball bearing assemblies can be employed such as a needle roller bearing, a cylindrical roller bearing, a self-aligning ball bearing as well as single row and double row bearings.

Most of the ball bearings manufactured presently are, in fact, electrically conductive between the inner and outer races. While the invention has wide spread capabilities for solving the problem of twisting telephone cables or lines, it will be readily understood that the invention can be employed with any other line such as electrical line cords and other lines which tend to twist, but it also requires an electrical connection between an input and output cable. The apparatus depicted is extremely reliable in operation in that the rod and the conductive plate, as shown, maintains correct positioning of a multi-wire cable for all twisting or coiling motions. Hence the assembly continuously prevents twisting and coiling of the output cable and, therefore, maintains the same in a non-twisted state.

Other alterations and modifications of the invention should be apparent to one skilled in the art from reading the above noted specification and are deemed to be encompassed within the breadth and scope of the claims appended hereto.

I claim:

1. Apparatus for preventing the undesirable twisting of an input wire or cable of a given length and of the type capable of twisting or coiling during use comprising: a housing having an input port and an output port and having an internal hollow, with said input wire directed into said hollow via said input port, a conductive ball bearing assembly having an outer and an inner race and operative to rotate with respect to one another about a common axis, with a central aperture associated with said inner race, with said outer race rigidly secured to said housing and having electrically coupled thereto said input wire, a plate located and positioned within said central aperture and fabricated from a conductive material, said plate electrically mounted to said inner race and having electrically attached thereto an output wire directed from said plate through said output port, said plate being of a partial circular configuration to therefore occupy a portion of said central aperture, and a rod coupled to said plate and extending within said housing, said output wire directed about said rod at a portion thereof, whereby if said output wire twists said inner race, plate and rod will rotate about said common axis to maintain said output wire in a non-twisted state.

2. The apparatus according to claim 1, wherein said input wire includes four separate wires, and wherein said housing contains four ball bearing assemblies each aligned with their central apertures coaxial and electrically separated one from the other, each of said assemblies associated with one of said four wires, with each of said four wires coupled to an associated outer race, with each of said output wires, directed through the space between said plate and central aperture of an adjacent assembly to said output port and with said rod coupled to each plate to cause each inner race and hence each output wire to rotate the same distance to thereby maintain the outer cable consisting of said four output wires in a non-twisted state.

3. The apparatus according to claim 2, wherein said input wire is a telephone cable.

4. The apparatus according to claim 3, wherein said input cable is terminated in a telephone male jack.

5. The apparatus according to claim 3, wherein said output cable is terminated in a male telephone jack.

6. The apparatus according to claim 2, wherein said rod as coupled to each of said plates is directed through coaxial apertures in each plate and extending beyond said bearing assemblies towards said output port with said output wires wrapped about said rod within said housing.

7. The apparatus according to claim 6, wherein said rod as coupled through said apertures includes at a first end a flange member to secure said rod against the first plate of said first bearing assembly closest to said input port.

8. The apparatus according to claim 2, including insulative spacers interposed between said bearing assemblies to selectively isolate one from the other.

9. The apparatus according to claim 8, wherein said insulative spacers are elastomeric annular rings having a larger inner diameter than said central aperture with an outer diameter relatively equal to the diameter of said outer race.

10. The apparatus according to claim 9, wherein said rings are fabricated from plastic.

11. The apparatus according to claim 10, wherein said rings are fabricated from rubber.

12. The apparatus according to claim 1, wherein said housing and rod are fabricated from a plastic.

13. The apparatus according to claim 1, wherein said plate is relatively between $\frac{2}{3}$ and $\frac{3}{4}$ of a circle having a diameter relatively equal to the diameter of said central aperture.

14. The apparatus according to claim 1, wherein said plate is welded to said inner race within said central aperture.

15. The apparatus according to claim 1, wherein said plate contains an elongated aperture into which the conductive end of said output wire is inserted and then selectively connected to said plate.

16. The appartus according to claim 15, wherein said wire is soldered to said plate.

17. The apparatus according to claim 16, wherein said wire is welded to said plate.

18. The apparatus according to claim 1, wherein said ball bearing assembly is a self-aligning ball bearing assembly.

19. The apparatus according to claim 1, wherein said ball bearing assembly is a cylindrical roller bearing.

20. The apparatus according to claim 1, wherein said ball bearing assembly is a needle roller bearing.

21. An apparatus for preventing the twisting of a cable having a plurality of wires, said apparatus comprising a hollow housing having an input port and output port for respectively receiving first and second input wires and first and second output wires; electrically conductive first and second assemblies arranged within said housing and electrically isolated from one another, said first and second assemblies being electrically connected to corresponding ones of said first and second input wires and said first and second output wires, said first and second assemblies each including an outer race rigidly secured to said housing and having a corresponding one of said first and second input wires electrically attached thereto, an inner race electrically coupled to said outer race and having a central aperture, an electrically conductive plate electrically mounted to said inner race within said central aperture and having a corresponding one of said first and second output wires electrically attached thereto, said plate constructed of a partial circular configuration to provide an unoccupied portion of said central aperture for receiving therethrough in electrical isolation output wires electrically attached to said plate of an adjacent assembly; and a rod coupled to a corresponding plate of said first and second assemblies for rotating each said inner race about a common axis with respect to each said outer race, said first and second output wires engaged by said rod whereby rotation of said output wires causes corresponding rotation of said inner race of said first and second assemblies to prevent twisting of said cable.

* * * * *